US011385590B1

(12) United States Patent
Shimada et al.

(10) Patent No.: US 11,385,590 B1
(45) Date of Patent: Jul. 12, 2022

(54) IMAGE CARRIER UNIT AND IMAGE FORMING APPARATUS

(71) Applicant: FUJIFILM Business Innovation Corp., Tokyo (JP)

(72) Inventors: Tomohiro Shimada, Kanagawa (JP); Yuta Hoshino, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/404,096

(22) Filed: Aug. 17, 2021

(30) Foreign Application Priority Data

Mar. 29, 2021 (JP) ..... JP2021-054457

(51) Int. Cl.
*G03G 21/16* (2006.01)

(52) U.S. Cl.
CPC ..... *G03G 21/1671* (2013.01)

(58) Field of Classification Search
CPC ..... G03G 15/0882; G03G 2215/088; G03G 2221/1609; G03G 2215/0687; G03G 2215/0692
See application file for complete search history.

(56) References Cited

U.S. PATENT DOCUMENTS 6,088,555 A 7/2000 Mizuno
8,086,136 B2 12/2011 Hayashi
2004/0057747 A1* 3/2004 Michlin ..... G03G 15/0884 399/106
2005/0191084 A1* 9/2005 Murakami ..... G03G 15/0882 399/111
2006/0127126 A1* 6/2006 Kim ..... G03G 21/1832 399/106
2007/0003320 A1* 1/2007 Park ..... G03G 21/1633 399/114
2008/0145097 A1* 6/2008 Tsui ..... G03G 21/1832 399/114
2010/0061760 A1* 3/2010 Kato ..... G03G 21/1832 399/111

FOREIGN PATENT DOCUMENTS

JP 59061845 A * 12/1984
JP 3507227 B2 3/2004
JP 3536577 B2 6/2004
JP 4835682 B2 12/2011

* cited by examiner

*Primary Examiner* — Sevan A Aydin
(74) *Attorney, Agent, or Firm* — Sughrue Mion, PLLC

(57) ABSTRACT

An image carrier unit, insertable into and removable from an apparatus housing, includes: an image carrier; a protection cover removable from and attachable to the image carrier and including a covering portion and a block, the covering portion covering an exposed portion of the image carrier, the block being disposed on a near side in an insertion-removal direction and protruding in a direction crossing the insertion-removal direction; and a surface opposing a far side of the block in the insertion-removal direction, wherein the block is pressed by a protrusion movable toward the apparatus housing.

19 Claims, 7 Drawing Sheets

IMAGE CARRIER UNIT AND IMAGE FORMING APPARATUS

CROSS-REFERENCE TO RELATED APPLICATIONS

This application is based on and claims priority under 35 USC 119 from Japanese Patent Application No. 2021-054457 filed Mar. 29, 2021.

BACKGROUND

(i) Technical Field

The present disclosure relates to an image carrier unit and an image forming apparatus.

(ii) Related Art

The following process cartridge is known (refer to Japanese Patent No. 3507227). The process cartridge includes an electrophotographic photoconductor, a process member that operates the electrophotographic photoconductor, a cartridge frame that accommodates the electrophotographic photoconductor and the process member and includes a guide portion engaged with a linear-motion guide of an electrophotographic image forming apparatus body, a protection cover that covers a portion of the electrophotographic photoconductor exposed to the outside, that is fitted to the linear-motion guide of the cartridge frame parallel to the guide portion of the cartridge frame, and that is removably attached to the cartridge frame. The protection cover includes an interfering portion. The interfering portion comes into contact with the electrophotographic image forming apparatus body when the process cartridge is incompletely inserted into and fitted to a streak groove in the electrophotographic image forming apparatus body shorter than the length of the process cartridge in an attachment-removal direction. When the interfering portion comes into contact with the electrophotographic image forming apparatus body while the protection cover is fitted to the streak groove, the cartridge frame is attached to the electrophotographic image forming apparatus body while leaving the protection cover incompletely attached.

The following photoconductor unit is also known (Japanese Patent No. 4835682). The photoconductor unit includes a photoconductor pivotally supported by the housing to be rotatable and at least partially exposed from the housing. The photoconductor unit is inserted into an image forming apparatus in an axial direction of the photoconductor. The photoconductor unit includes a light-shielding sheet directly fixed to a housing to cover part of the photoconductor on a first side in the axial direction, a hard cover disposed adjacent to the light-shielding sheet on a second side in the axial direction or disposed to overlap part of the light-shielding sheet, fitted to a portion of the housing at the second end in the axial direction, and positioned with respect to the housing to form a grip for insertion into the image forming apparatus, and a buffer member interposed between the hard cover and the photoconductor. The hard cover has a length that allows the photoconductor unit to be gripped on the hard cover. The light-shielding sheet, the hard cover, and the buffer member are integrally removable from the photoconductor.

SUMMARY

Aspects of non-limiting embodiments of the present disclosure relate to a structure that prevents a printing operation from being performed while a protection cover is attached to an image carrier.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided an image carrier unit insertable into and removable from an apparatus housing, the image carrier unit including: an image carrier; a protection cover removable from and attachable to the image carrier and including a covering portion and a block, the covering portion covering an exposed portion of the image carrier, the block being disposed on a near side in an insertion-removal direction and protruding in a direction crossing the insertion-removal direction; and a surface opposing a far side of the block in the insertion-removal direction, wherein the block is pressed by a protrusion movable toward the apparatus housing.

BRIEF DESCRIPTION OF THE DRAWINGS

Exemplary embodiments of the present disclosure will be described in detail based on the following figures, wherein.

DETAILED DESCRIPTION

With reference to the drawings, the present disclosure will be described further in detail below while taking exemplary embodiments and specific examples as examples. However, the present disclosure is not limited to these exemplary embodiments and specific examples.

In the following description with reference to the drawings, the drawings are schematic, and have the ratios between the dimensions different from the actual ones. For ease of understanding, components other than those used for the description are omitted from the drawings as appropriate.

For ease of understanding the following description, throughout the drawings, the front-rear direction is indicated as an X axis direction, the left-right direction is indicated as a Y axis direction, and the vertical direction is indicated as a Z axis direction.

Figure 1:
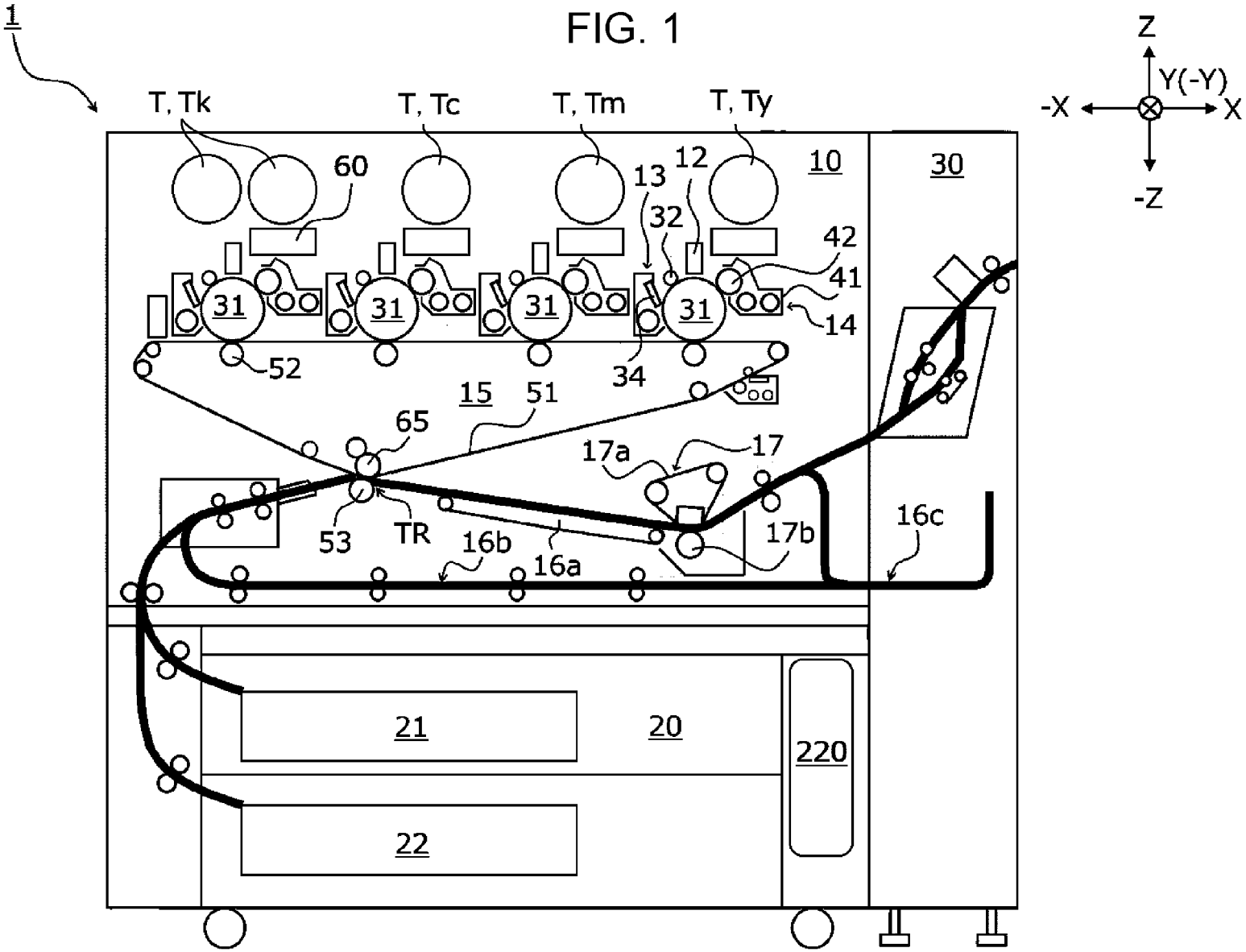
FIG. 1 is a cross-sectional schematic diagram of an example of a schematic structure of an image forming apparatus.

(1) Entire Structure and Operation of Image Forming Apparatus (1.1) Entire Structure of Image Forming Apparatus FIG. 1 is a cross-sectional schematic diagram of an example of a schematic structure of an image forming apparatus 1 according to the present exemplary embodiment.

The image forming apparatus 1 includes an image forming portion 10, a sheet feeder 20 attached to a first end of the image forming portion 10, a sheet discharger 30 disposed at a second end of the image forming portion 10 and to which printed sheets are discharged, and an image processor (not illustrated) that generates image information based on print information transmitted from a host device.

The image forming portion 10 includes a system controller (not illustrated), exposure devices 12, photoconductor units 13, development devices 14, a transfer device 15, sheet transport devices 16*a*, 16*b*, and 16*c*, a fixing device 17, and a driving device (not illustrated). The image forming portion 10 forms image information received from the image processor into a toner image on a sheet fed from the sheet feeder 20.

The sheet feeder 20 feeds sheets to the image forming portion 10. Specifically, the sheet feeder 20 includes multiple sheet containers that accommodate sheets of different types (for example, different in material, thickness, sheet size, or paper grain). The sheet feeder 20 feeds sheets picked up from one of these sheet containers to the image forming portion 10.

The sheet discharger 30 discharges sheets carrying images output from the image forming portion 10. Thus, the sheet discharger 30 includes a discharged-sheet receiver that receives sheets to which images have been output. The sheet discharger 30 may have a function of performing postprocessing, such as cutting or stapling, on a stack of sheets output from the image forming portion 10.

(1.2) Structure and Operation of Image Forming Portion

In the image forming apparatus 1 with this structure, each sheet picked up from one of the sheet containers in the sheet feeder 20 designated by a print job for each print is fed to the image forming portion 10 at the timing of image formation.

The photoconductor units 13 serving as examples of image forming units include photoconductor drums 31 that are arranged parallel to each other below the exposure devices 12 and serve as image carriers driven to rotate. A charging roller 32, the exposure device 12, the development device 14, a first transfer roller 52, and a cleaning blade 34 are arranged in the rotation direction of each photoconductor drum 31.

Each development device 14 includes a development housing 41 that accommodates a developer inside. Inside the development housing 41, a development roller 42 is disposed to oppose the corresponding photoconductor drum 31.

The development devices 14 have substantially the same structure except for the development housings 41 accommodating different developers to respectively form toner images of yellow (Y), magenta (M), cyan (C), and black (K).

A replaceable toner cartridge T and a developer feeder 60 are disposed above each development device 14. The toner cartridge T accommodates a developer (toner including a carrier). The developer feeder 60 feeds the developer from the toner cartridge T to the development device 14. In the present exemplary embodiment, toner cartridges Ty, Tm, and Tc for yellow (Y), magenta (M), and cyan (C) and two toner cartridges Tk for black (K) are removably attached.

The surface of each rotating photoconductor drum 31 is charged by the corresponding charging roller 32 with electricity, and receives an electrostatic latent image formed from latent-image-forming light emitted from the exposure device 12. The electrostatic latent image formed on the photoconductor drum 31 is developed by the development roller 42 as a toner image.

The transfer device 15 includes an intermediate transfer belt 51, first transfer rollers 52, and a second transfer roller 53. To the intermediate transfer belt 51, the toner images of different colors formed on the photoconductor drums 31 of the photoconductor units 13 are transferred in a superposed manner. The first transfer rollers 52 sequentially transfer (first-transfer) the toner images of different colors formed by the photoconductor units 13 to the intermediate transfer belt 51. The second transfer roller 53 collectively transfers (second-transfers) the toner images of different colors transferred to the intermediate transfer belt 51 in a superposed manner to a sheet serving as a recording medium.

The toner images of different colors formed on the photoconductor drums 31 of the photoconductor units 13 are sequentially electrostatically transferred (first-transferred) onto the intermediate transfer belt 51 by the first transfer rollers 52 that have received a predetermined transfer voltage from, for example, a power supply (not illustrated) controlled by the system controller. Thus, a superposed toner image including toner of different colors is formed.

In accordance with movement of the intermediate transfer belt 51, the superposed toner image on the intermediate transfer belt 51 is transported to the second transfer portion TR where the second transfer roller 53 is pressed against a back-up roller 65 with the intermediate transfer belt 51 interposed therebetween.

Concurrent with the arrival of the superposed toner image at the second transfer portion TR, a sheet is fed from the sheet feeder 20 to the second transfer portion TR. A predetermined second transfer voltage is applied from a power supply controlled by the system controller to the back-up roller 65 that opposes the second transfer roller 53 with the intermediate transfer belt 51 interposed therebetween. The superposed toner image on the intermediate transfer belt 51 is thus collectively transferred to a sheet.

Remaining toner on the surface of each photoconductor drum 31 is removed by the cleaning blade 34, and collected into a waste toner container (not illustrated). Each charging roller 32 recharges the surface of the corresponding photoconductor drum 31 with electricity.

The fixing device 17 includes an endless fixing belt 17*a* that rotates unidirectionally, and a pressing roller 17*b* that is in contact with the peripheral surface of the fixing belt 17*a* and rotates unidirectionally. A nip portion (fixing area) is formed in an area where the fixing belt 17*a* and the pressing roller 17*b* are in pressure contact with each other.

The sheet to which the toner image is transferred by the transfer device 15 is transported to the fixing device 17 via the sheet transport device 16*a* while having the toner image unfixed. The sheet P transported by the fixing device 17 has the toner image fixed by the fixing belt 17*a* and the pressing roller 17*b* with the effects of pressure contact and heating.

The sheet P subjected to fixing is fed to the sheet discharger 30 via the sheet transport device 16*b*.

To output images on both surfaces of each sheet, the sheet is turned upside down by the sheet transport device 16*c* and fed again to the second transfer portion TR in the image forming portion 10. After the toner image is transferred and the transfer image is fixed, the sheet is fed to the sheet discharger 30. The sheet fed to the sheet discharger 30 is discharged to the discharged-sheet receiver after being subjected to postprocessing such as cutting or stapling as appropriate.

(2) Unit Structure and Attachment Operation of Image Forming Apparatus

Figure 2:
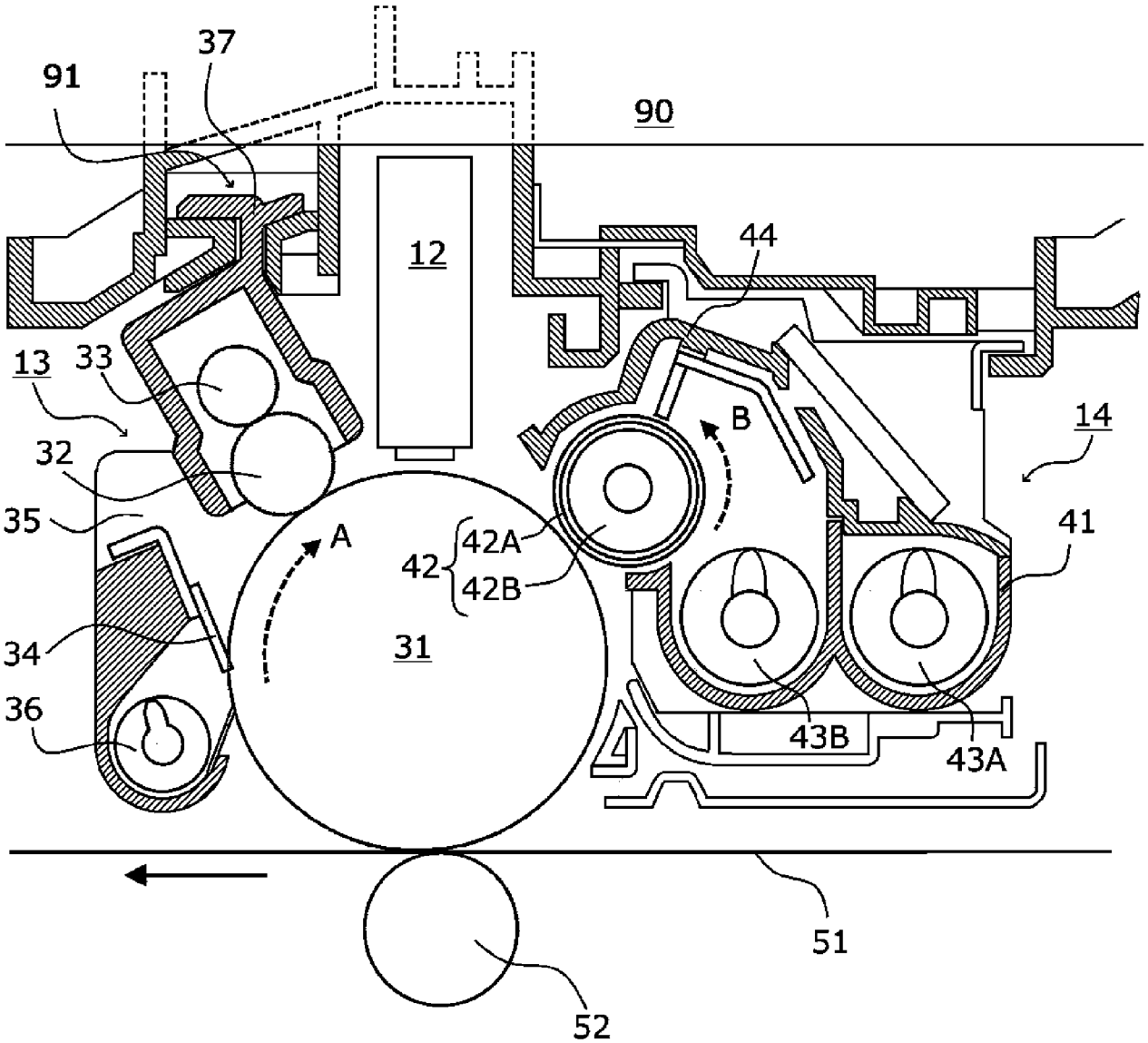
FIG. 2 is a cross-sectional schematic diagram illustrating a unit structure in the image forming apparatus.

FIG. 2 is a cross-sectional schematic diagram of a unit structure of the image forming apparatus 1. The structure and an attachment operation of the photoconductor unit 13 and the development device 14 will be described below with reference to the drawings.

As illustrated in FIG. 2, in the image forming apparatus 1, the photoconductor unit 13 and the development device 14 are removably accommodated in an apparatus housing 90.

(2.1) Photoconductor Unit

In each photoconductor unit 13, as illustrated in FIG. 2, the photoconductor drum 31 is rotatably (drawn with arrow A in FIG. 2) supported by a unit housing 35. The unit housing 35 accommodates the charging roller 32, a cleaning roller 33, the cleaning blade 34, and a transport auger 36 that transports toner removed by the cleaning blade 34 to a waste toner transporter 200 (refer to FIGS. 7A and 7B).

A hook-shaped hook 37 that is engaged with a guide 91 in the apparatus housing 90 is integrated with the unit housing 35. The hook 37 protrudes upward (in the Z direction) to the uppermost position of the photoconductor unit 13, and extends from the near side to the far side of the photoconductor unit 13. The hook 37 is engaged with the guide 91 in the apparatus housing 90 to guide the photoconductor unit 13 to be attached to the apparatus housing 90.

A protection cover 100 that covers the surface of the photoconductor drum 31 exposed to the outside for protection is removably attached to the photoconductor unit 13. The protection cover 100 prevents the surface of the photoconductor drum 31 from being damaged due to falling or vibrations while the photoconductor unit 13 is unused. The protection cover 100 is removed after the photoconductor unit 13 is attached to the apparatus housing 90.

(2.2) Development Device

As illustrated in FIG. 2, in the development device 14, the development roller 42 is rotatably supported by the development housing 41. The development housing 41 accommodates an agitation auger 43A and a supply auger 43B. The portion in the development housing 41 around the agitation auger 43A and the supply auger 43B is filled with the developer, and is covered with a cover member 44.

The development roller 42 includes a hollow cylindrical development sleeve 42A rotatably supported by the development housing 41, and a magnet 42B that is a solid cylindrical magnet member disposed inside the development sleeve 42A and fixed to the development housing 41.

The development sleeve 42A holds the developer on its outer periphery with the magnetic force of the magnet 42B, and transports the developer with rotation of the development sleeve 42A (indicated with arrow B in FIG. 2) to the electrostatic latent image on the photoconductor drum 31.

(2.3) Protection Cover

Figure 3:
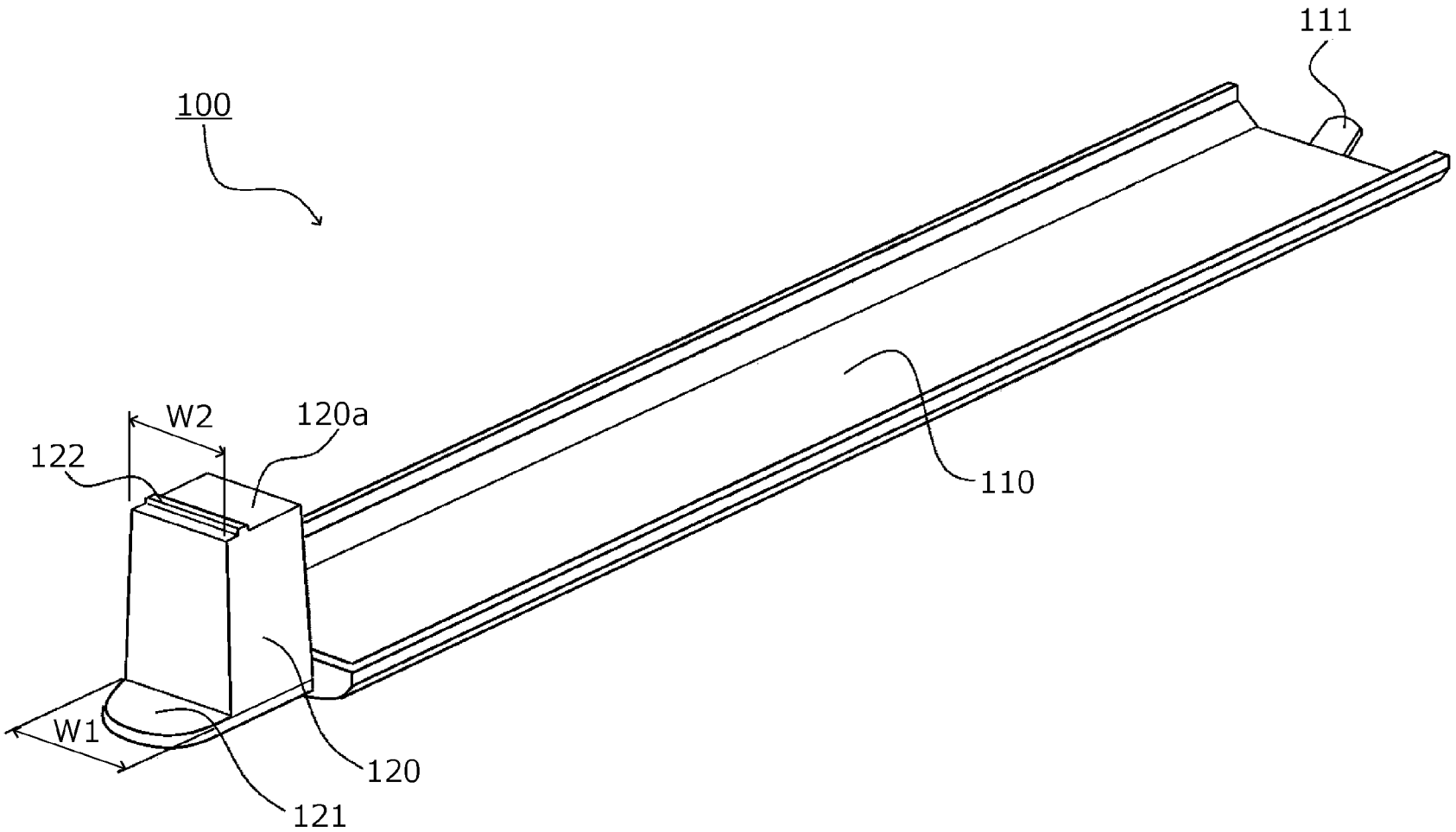
FIG. 3 is a perspective view of the entire structure of a protection cover.
Figure 4A:
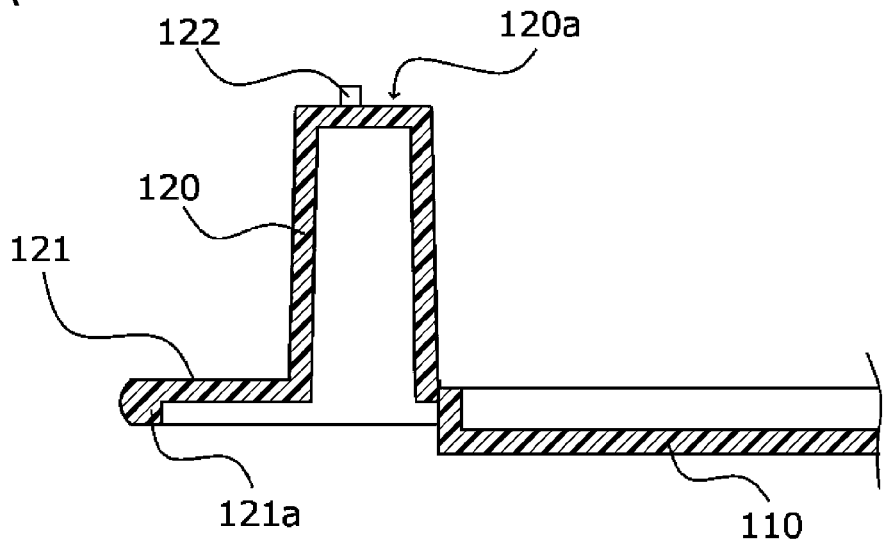
FIG. 4A is a cross-sectional schematic diagram of a structure of a block of the protection cover.
Figure 4B:
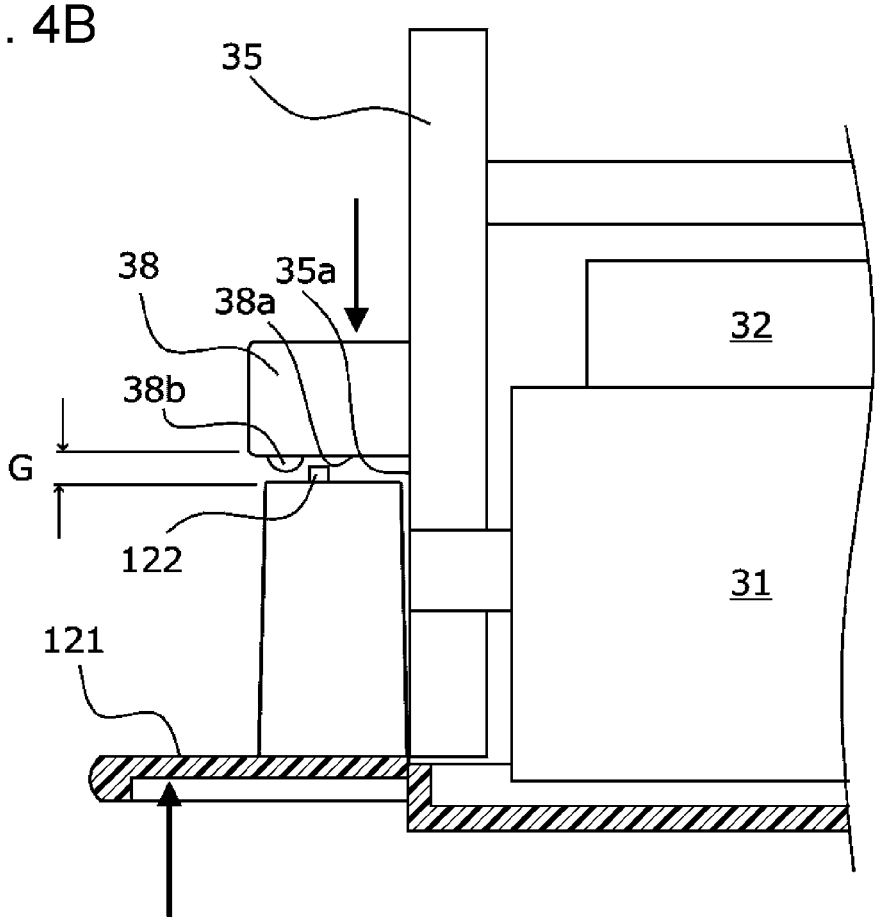
FIG. 4B is a cross-sectional schematic diagram of the protection cover attached to a photoconductor unit.

FIG. 3 is a perspective view of the entire structure of the protection cover 100. FIG. 4A is a cross-sectional schematic diagram of a structure of a block 120 of the protection cover 100, and FIG. 4B is a cross-sectional schematic diagram of the protection cover 100 attached to the photoconductor unit 13. The structure of the protection cover 100 will be described below with reference to the drawings.

The protection cover 100 includes a covering portion 110 and a block 120. The covering portion 110 covers an exposed portion of the surface of the photoconductor drum 31 exposed to the outside. The block 120 is integrated with the covering portion 110 and disposed in front of the photoconductor unit 13 in the insertion-removal direction. The protection cover 100 is formed from synthetic resin, such as polypropylene, that is solid without being significantly deformed when gripped by a user.

The covering portion 110 extends in the longitudinal direction of the photoconductor unit 13 to cover the exposed surface of the photoconductor drum 31. An attachment portion 111 fitted into the unit housing 35 is formed on the far side of the covering portion 110 in the insertion-removal direction of the photoconductor unit 13.

The block 120 is a quadrangular prism having a predetermined thickness, width, and height. The block 120 includes a tab 121 on the bottom surface. The tab 121 extends to the near side in the insertion-removal direction to be grippable from the front side of the apparatus housing 90. As illustrated in the cross section in FIGS. 4A and 4B, the tab 121 is thinned in the thickness direction, and has a nonslip portion 121*a* on the back surface to be gripped by a user when the user draws out the tab 121 to the near side. The block 120 has a larger width on the bottom surface where the tab 121 is disposed than on the upper surface to facilitate gripping of the protection cover 100 (W1>W2 in FIG. 3).

A rib 122 is formed on an upper surface 120*a* of the block 120. The rib 122 extends in the direction crossing the insertion-removal direction and protrudes upward. As illustrated in FIG. 4B, the unit housing 35 disposed on the near side in the insertion-removal direction of the photoconductor unit 13 includes a handle 38 grippable (indicated with arrows in FIG. 4B) together with the tab 121 of the protection cover 100. The handle 38 includes a rib 38*b* on a lower surface 38*a* thereof. The rib 38*b* protrudes downward and extends in a direction crossing the insertion-removal direction.

A gap G between the upper surface 120*a* of the block 120 and the lower surface 38*a* of the handle 38 is narrowed so that the handle 38 and the tab 121 come into contact with each other when gripped. The rib 38*b* on the lower surface 38*a* of the handle 38 and the rib 122 on the upper surface 120*a* of the block 120 overlap each other in the insertion-removal direction at different positions. Thus, the protection cover 100 is prevented from being shifted to the near side when the photoconductor unit 13 and the protection cover 100 are gripped together.

(3) Attachment of Photoconductor Unit and Operation of Protection Cover

Figure 5A:
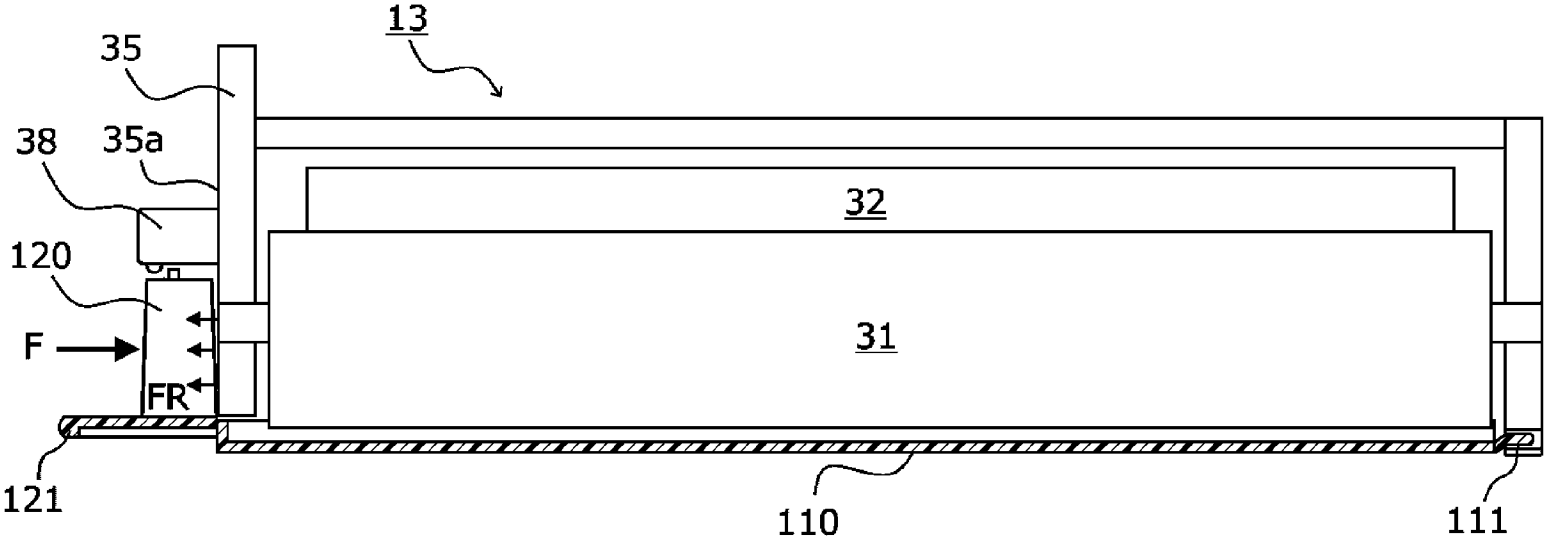
FIG. 5A is a cross-sectional schematic diagram, taken in the axial direction, of the photoconductor unit to which the protection cover is attached.
Figure 5B:
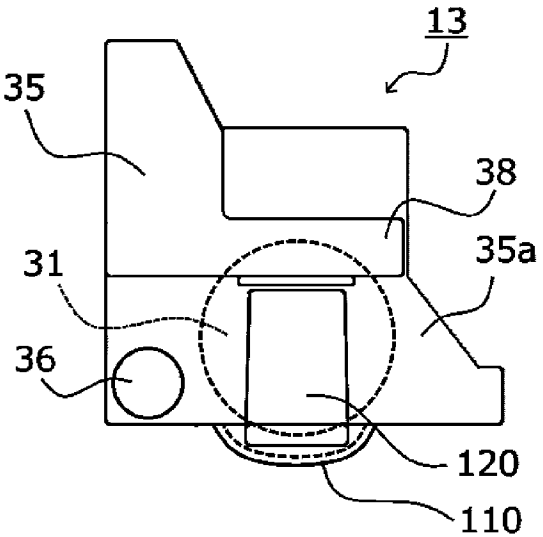
FIG. 5B is a front view of the photoconductor unit to which the protection cover is attached.
Figure 6:
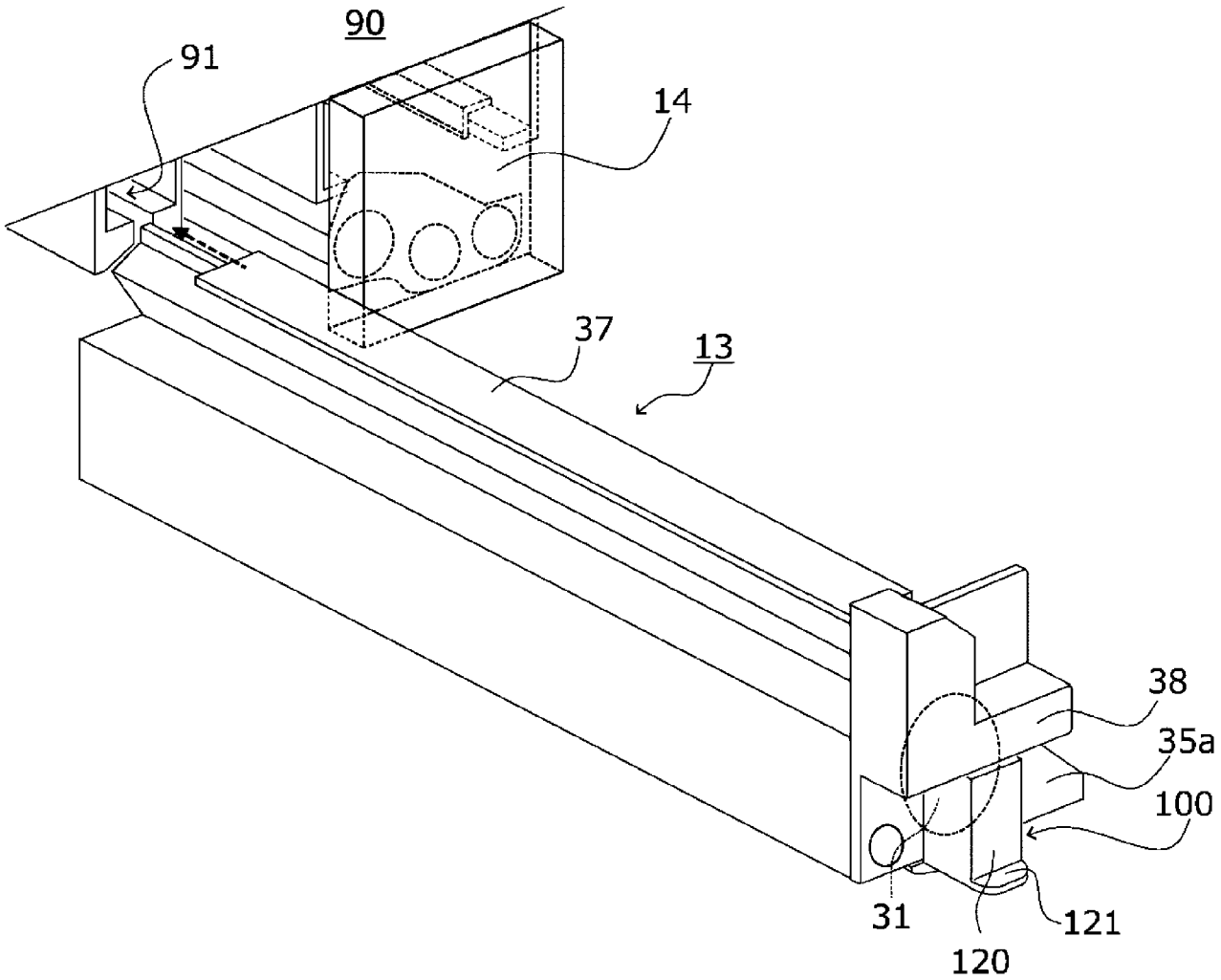
FIG. 6 is a perspective view illustrating attachment of the photoconductor unit to an apparatus housing.

FIG. 5A is a cross-sectional schematic diagram, taken in the axial direction, of the photoconductor unit 13 to which the protection cover 100 is attached, and FIG. 5B is a front view of the photoconductor unit 13 to which the protection cover 100 is attached. FIG. 6 is a perspective view illustrating attachment of the photoconductor unit 13 to the apparatus housing 90. FIG. 7 is a cross-sectional schematic diagram illustrating the relationship between a protrusion and the protection cover 100 left unremoved.

The operation of the protection cover 100 will be described below with reference to the drawings.

As illustrated in FIG. 5A, the protection cover 100 that protects the exposed portion of the photoconductor drum 31 is attached to the photoconductor unit 13. The protection cover 100 is removably attached to the photoconductor unit 13 while having the attachment portion 111 fitted into a hole of the unit housing 35 on the far side in the insertion-removal direction of the photoconductor unit 13.

In the protection cover 100 attached to the photoconductor unit 13, the block 120 on the near side opposes, in the insertion-removal direction of the photoconductor unit 13, a surface 35*a* of the unit housing 35 on the near side to be in contact with the surface 35*a*. Thus, when an external force is exerted on the block 120, the block 120 receives the external force while coming into contact with the surface 35*a* of the unit housing 35 on the near side (drawn with arrows F and FR in FIG. 5A).

In the vertical direction crossing the insertion-removal direction, the block 120 opposes the handle 38 integrated with the unit housing 35 and protruding from the surface 35*a* on the near side while having the gap G therebetween. Thus, the photoconductor unit 13 is attachable while the user grips the handle 38 together with the tab 121 integrated with the bottom surface of the block 120.

As illustrated in FIG. 6, the photoconductor unit 13 to which the protection cover 100 is attached is caused to slide toward the guide 91 (refer to an arrow in FIG. 6) while the development device 14 is attached to the apparatus housing 90 in advance, and the hook 37 of the photoconductor unit 13 is moved to the far side while being placed on the guide 91. Then, a set lever (not illustrated) that has a rotation support on the development device 14 is rotated toward the photoconductor unit 13 to fix the photoconductor unit 13 to the apparatus housing 90. Thereafter, the protection cover 100 is removed from the photoconductor unit 13.

The operation of the protection cover 100 to operate the image forming apparatus 1 while the protection cover 100 is left attached to the photoconductor unit 13 attached to the apparatus housing 90 will be described with reference to FIGS. 7A and 7B.

Figure 7A:
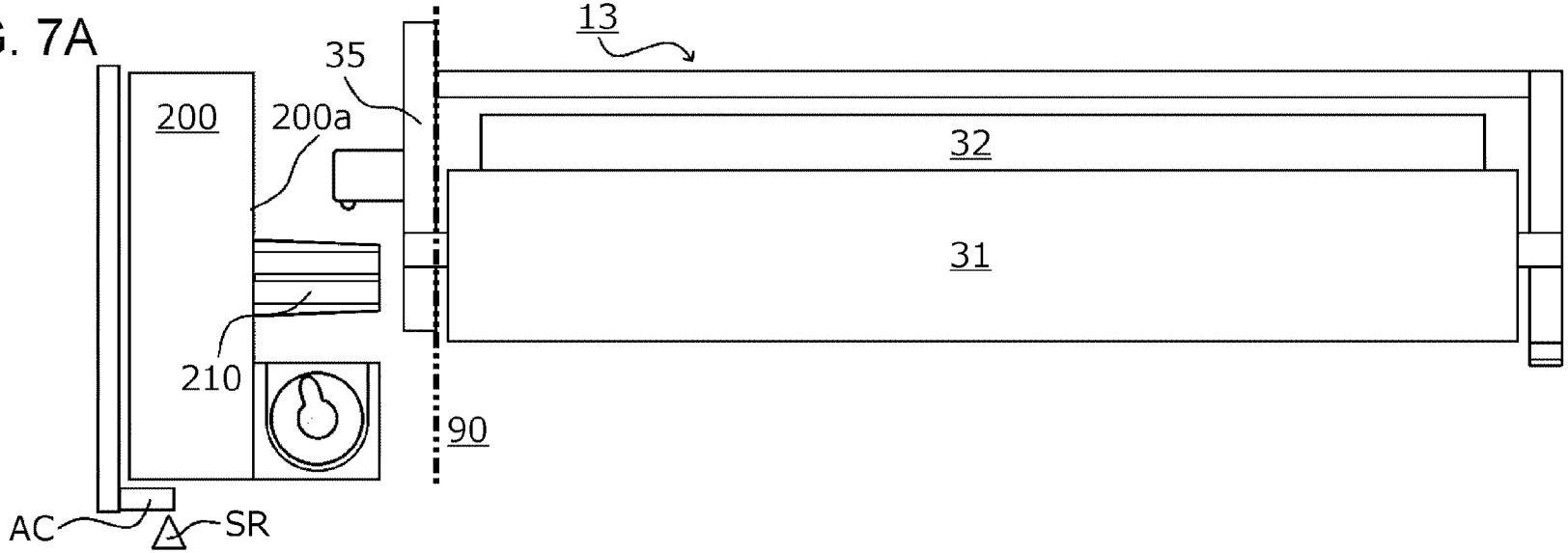
FIGS. 7A and 7B are cross-sectional schematic diagrams illustrating the relationship between a protrusion and the protection cover left unremoved.
Figure 7B:
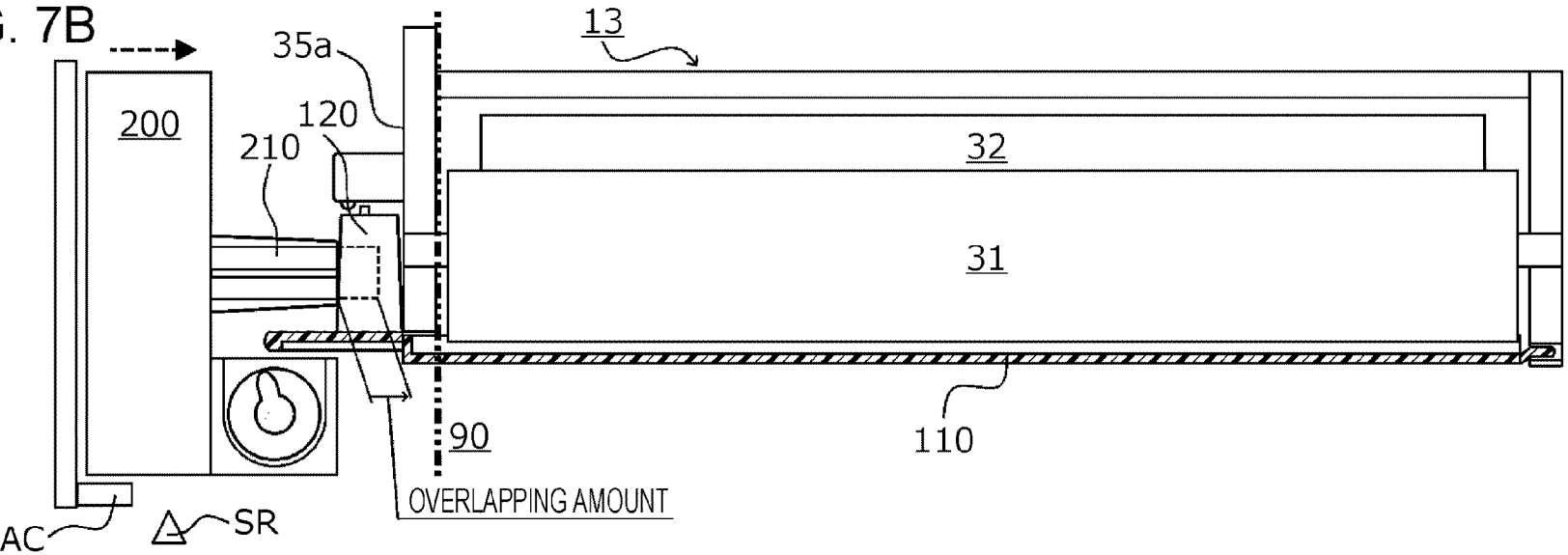

As illustrated in FIG. 7A, the waste toner transporter 200 serving as an example of a body member that allows the image forming apparatus 1 to operate by moving to the front side of the apparatus housing 90 is removably attached to the image forming apparatus 1. The waste toner transporter 200 transports waste toner discharged from the photoconductor unit 13 and the developer discharged from the development device 14 to a reclaim container 220 (refer to FIG. 1).

The waste toner transporter 200 includes a protrusion 210 that protrudes toward the apparatus housing 90 on a surface 200*a* opposing the photoconductor unit 13. The protrusion 210 is a columnar body reinforced with a rib. The protrusion 210 has a height with which the protrusion 210 overlaps the block 120 in the protection cover 100 by an overlapping amount exceeding a range within which a sensor SR determines the position of the waste toner transporter 200 as being normal when the waste toner transporter 200 moves to a predetermined fixed position toward the apparatus housing 90. Specifically, the protrusion 210 has a height with which the protrusion 210 overlaps the block 120 by an overlapping amount equal to or higher than ⅓ of the thickness of the block 120. Thus, as illustrated in FIG. 7B, when the protection cover 100 of the photoconductor unit 13 attached to the apparatus housing 90 is left attached without being removed, the waste toner transporter 200 fails to move to a predetermined fixed position while having the protrusion 210 coming into contact with the block 120. Thus, an actuator AC of the front cover fails to be detected by the sensor SR, and the image forming apparatus 1 fails to operate.

The block 120 pressed by the protrusion 210 comes into contact with the surface 35*a* of the unit housing 35 and fails to move further in a direction in which the protrusion 210 moves. Thus, the waste toner transporter 200 fails to move to the predetermined fixed position, and the image forming apparatus 1 fails to shift to an operable state.

This structure prevents a printing operation from being performed while the protection cover 100 is left attached. The protrusion 210 may be disposed on a front cover of the openable image forming apparatus 1. However, when the protrusion 210 is disposed on a rotatable front cover, the protrusion 210 may obliquely come into contact with the block 120 and may be displaced. Moreover, when obliquely coming into contact with the block 120, the protrusion 210 may buckle upon receipt of the load also in the direction crossing the protrusion direction. Thus, the protrusion 210 preferably moves horizontally toward the block 120. When perpendicularly coming into contact with the opposing surface of the block 120, the protrusion 210 is prevented from being displaced or buckling without receiving the load in the direction crossing the protrusion direction.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image carrier unit insertable into and removable from an apparatus housing, comprising:

an image carrier;

a protection cover removable from and attachable to the image carrier and including a covering portion and a block, the covering portion covering an exposed portion of the image carrier, the block being disposed on a near side in an insertion-removal direction and protruding in a direction crossing the insertion-removal direction; and a surface opposing a far side of the block in the insertion-removal direction, wherein the block is pressed by a protrusion movable toward the apparatus housing.

2. The image carrier unit according to claim 1, wherein the protection cover includes a tab that is disposed on a bottom surface of the block to extend to the near side in the insertion-removal direction, and that is grippable from a front side of the apparatus housing.

3. The image carrier unit according to claim 2, wherein the block has the bottom surface wider than an upper surface.

4. The image carrier unit according to claim 3, wherein the image carrier unit includes a handle on the near side in the insertion-removal direction to be grippable together with the tab for insertion and removal of the image carrier unit, and wherein the upper surface of the block and a lower surface of the handle define a gap that is narrowed when the block and the handle are gripped to bring the upper surface and the lower surface into contact with each other.

5. The image carrier unit according to claim 4, wherein the block includes a rib on an upper surface of the block and, when the handle and the tab are gripped, the rib is engaged with a rib of the handle on the lower surface of the handle at a position different from a position of the rib of the handle to overlap with the rib of the handle in the insertion-removal direction.

6. The image carrier unit according to claim 2, wherein the image carrier unit includes a handle on the near side in the insertion-removal direction to be grippable together with the tab for insertion and removal of the image carrier unit, and wherein the upper surface of the block and a lower surface of the handle define a gap that is narrowed when the block and the handle are gripped to bring the upper surface and the lower surface into contact with each other.

7. The image carrier unit according to claim 6, wherein the block includes a rib on an upper surface of the block and, when the handle and the tab are gripped, the rib is engaged with a rib of the handle on the lower surface of the handle at a position different from a position of the rib of the handle to overlap with the rib of the handle in the insertion-removal direction.

8. The image carrier unit according to claim 2, wherein the tab includes a nonslip portion on a gripped surface to prevent slipping when being pulled out to the near side.

9. The image carrier unit according to claim 8, wherein the block has the bottom surface wider than an upper surface.

10. The image carrier unit according to claim 9, wherein the image carrier unit includes a handle on the near side in the insertion-removal direction to be grippable together with the tab for insertion and removal of the image carrier unit, and wherein the upper surface of the block and a lower surface of the handle define a gap that is narrowed when the block and the handle are gripped to bring the upper surface and the lower surface into contact with each other.

11. The image carrier unit according to claim 10, wherein the block includes a rib on an upper surface of the block and, when the handle and the tab are gripped, the rib is engaged with a rib of the handle on the lower surface of the handle at a position different from a position of the rib of the handle to overlap with the rib of the handle in the insertion-removal direction.

12. The image carrier unit according to claim 8, wherein the image carrier unit includes a handle on the near side in the insertion-removal direction to be grippable together with the tab for insertion and removal of the image carrier unit, and wherein the upper surface of the block and a lower surface of the handle define a gap that is narrowed when the block and the handle are gripped to bring the upper surface and the lower surface into contact with each other.

13. The image carrier unit according to claim 12, wherein the block includes a rib on an upper surface of the block and, when the handle and the tab are gripped, the rib is engaged with a rib of the handle on the lower surface of the handle at a position different from a position of the rib of the handle to overlap with the rib of the handle in the insertion-removal direction.

14. An image forming apparatus, comprising:

an image carrier unit removable from and attachable to an apparatus housing and including an image carrier;

a protection cover removable from and attachable to the image carrier unit and including a covering portion and a block, the covering portion covering an exposed portion of the image carrier, the block being disposed on a near side in an insertion-removal direction of the image carrier unit and protruding to cross the insertion-removal direction, the block opposing a surface of the image carrier; and a protrusion being movable with respect to the apparatus housing and pressing the block of the protection cover attached to the image carrier unit inserted into the apparatus housing.

15. The image forming apparatus according to claim 14, wherein the protrusion is attached to a body member that allows the image forming apparatus to operate by moving, moves horizontally toward the block in response to movement of the body member, and substantially perpendicularly comes into contact with a surface of the block.

16. The image forming apparatus according to claim 14, wherein the protrusion has an amount by which the protrusion is to overlap the block, and comes into contact with the block to fail to move to a predetermined position when the protection cover is attached to the image carrier.

17. The image forming apparatus according to claim 15, wherein the protrusion has an amount by which the protrusion is to overlap the block, and comes into contact with the block to fail to move to a predetermined position when the protection cover is attached to the image carrier.

18. The image forming apparatus according to claim 16, wherein the amount by which the protrusion is to overlap the block exceeds a range within which a sensor determines a unit position as being normal.

19. The image forming apparatus according to claim 17, wherein the amount by which the protrusion is to overlap the block exceeds a range within which a sensor determines a unit position as being normal.

* * * * *